US009310031B2

(12) United States Patent
Su et al.

(10) Patent No.: US 9,310,031 B2
(45) Date of Patent: Apr. 12, 2016

(54) LIGHT EMITTING DIODE BULB

(71) Applicant: InterLight Optotech Corporation, Taoyuan County (TW)

(72) Inventors: Hwa Su, Taoyuan County (TW); Tzu-Chi Cheng, Taoyuan County (TW); Hong-Zhi Liu, Taoyuan County (TW)

(73) Assignee: INTERLIGHT OPTOTECH CORPORATION, Yangmei, Taoyuan County (TW)

( * ) Notice: Subject to any disclaimer, the term of this patent is extended or adjusted under 35 U.S.C. 154(b) by 231 days.

(21) Appl. No.: 13/911,435

(22) Filed: Jun. 6, 2013

(65) Prior Publication Data

US 2014/0362568 A1 Dec. 11, 2014

(51) Int. Cl.
*F21K 99/00* (2010.01)

(52) U.S. Cl.
CPC ..... *F21K 9/135* (2013.01)

(58) Field of Classification Search
CPC ... F21V 23/003; F21V 23/006; F21V 23/007; F21K 2/00; F21K 9/135
USPC ..... 362/235
See application file for complete search history.

(56) References Cited

U.S. PATENT DOCUMENTS

| | | | | |
|---|---|---|---|---|
| 5,463,280 | A * | 10/1995 | Johnson | 315/187 |
| 5,688,042 | A * | 11/1997 | Madadi et al. | 362/240 |
| 5,726,535 | A * | 3/1998 | Yan | 315/185 R |
| 5,924,784 | A * | 7/1999 | Chliwnyj et al. | 362/234 |
| 6,465,961 | B1 * | 10/2002 | Cao | 315/58 |
| 7,163,324 | B2 * | 1/2007 | Pederson | 362/540 |
| 7,396,142 | B2 * | 7/2008 | Laizure et al. | 362/240 |
| 8,143,634 | B2 * | 3/2012 | Park et al. | 257/98 |
| D662,231 | S * | 6/2012 | Sakamoto et al. | D26/2 |
| 8,371,722 | B2 * | 2/2013 | Carroll | 362/311.02 |
| 8,403,509 | B2 * | 3/2013 | Chin et al. | 362/35 |
| 8,410,726 | B2 * | 4/2013 | Dau et al. | 315/312 |
| 8,545,056 | B2 * | 10/2013 | Kajiya et al. | 362/249.04 |
| 8,653,723 | B2 * | 2/2014 | Cao et al. | 313/46 |
| 8,801,224 | B2 * | 8/2014 | Huang et al. | 362/249.04 |
| 8,820,966 | B2 * | 9/2014 | Igaki et al. | 362/256 |
| 2002/0048174 | A1 * | 4/2002 | Pederson | 362/487 |
| 2002/0176253 | A1 * | 11/2002 | Lee | 362/249 |
| 2005/0174769 | A1 * | 8/2005 | Yong et al. | 362/235 |
| 2011/0103055 | A1 * | 5/2011 | Carroll | 362/235 |
| 2011/0163681 | A1 * | 7/2011 | Dau et al. | 315/191 |

FOREIGN PATENT DOCUMENTS

| | | | |
|---|---|---|---|
| CN | 201964196 | U | 9/2011 |
| TW | 201221847 | A | 6/2012 |
| WO | WO 2012/115883 | A1 | 8/2012 |

* cited by examiner

*Primary Examiner* — Sharon Payne
(74) *Attorney, Agent, or Firm* — Muncy, Geissler, Olds & Lowe, P.C.

(57) ABSTRACT

A LED bulb includes a circuit board, a lighting module, a conductive connector, and a lamp shade. The circuit board includes a slot. The lighting module is arranged on the circuit board and includes a transmissive substrate. The lighting module includes a circuit layer attached to the transmissive substrate, an electrode component arranged on one end of the transmissive substrate and inserted into the slot and electrically connected to the circuit layer, and a plurality of LED dies placed on the transmissive substrate and electrically connected to the circuit layer. The conductive connector is arranged on the other side of the circuit board and electrically connected to the circuit. The lamp shade is assembled with the conductive connector such that the circuit board and the lighting module are arranged between the conductive connector and the lamp shade.

10 Claims, 5 Drawing Sheets

LIGHT EMITTING DIODE BULB

BACKGROUND OF THE INVENTION

1. Field of the Invention

The present invention relates to a light emitting diode bulb, and in particular to a light emitting diode bulb using transmissive substrate for carrying light emitting diode dies.

2. Description of Related Art

A light emitting diode (LED) is a kind of semiconductor device, which exploits the property of direct-bandgap semiconductor material to convert electric energy into light energy efficiently and has the advantages of long service time, high stability and low power consumption and is developed to replace the traditional non-directivity light tube and incandescent lamp.

Referred is made to FIG. 1, which is a sectional view of a conventional light emitting diode (LED) bulb. The LED bulb 20 includes a housing 200, a circuit board 210, a plurality of light emitting diodes (LEDs) 226, a lamp shade 226, and a conductive connector 240. The circuit board 210 and conductive connector 240 are respectively disposed on two opposite sides of the housing 200. The circuit board 210 is of plate-shape and a surface with larger area of the circuit board 219 is attached to the housing 200. The LEDs 226 are placed on the surface with larger area of the circuit board 210 and electrically connected to the circuit board 210. The circuit board 210 provides an electric power to the LEDs 226 for lighting the LEDs 226, light emitted from the LEDs 226 transmits towards a direction opposite to the housing 200. The lamp shade 230 is assembled with the housing 220 such that the circuit board 210 and the LEDs 226 are arranged between the housing 200 and the lamp shade 230.

However, the LEDs 226 are light source having characteristic of directivity such that light emitted from the LEDs 226 just can transmit forwards (namely, the light emitted from the LEDs 226 transmits to a direction opposite to the housing 200), such that the illuminant area and lighting demand of the LED bulb 20 cannot compete with incandescent bulb for non-directivity requirement, and then usage desire of user is reduced.

SUMMARY OF THE INVENTION

It is an object to provide a light emitting diode (LED) bulb, the light emitting diode bulb has transmissive substrate for carrying LED dies.

Accordingly, the LED bulb comprises a circuit board, at least one lighting module, a conductive connector, and a lamp shade. The circuit board comprises at least one slot. The lighting module is arranged on one side of the circuit board. The lighting module comprises a transmissive substrate, a circuit layer, an electrode component, and a plurality of LED dies. The transmissive substrate comprises a first surface and a second surface opposite to the first surface. The circuit layer is attached to at least one of the first surface and the second surface. The electrode component is arranged on one end of the transmissive substrate. The electrode component is inserted into the slot and electrically connected to the circuit layer. The LED dies are placed on at least one of the first surface and the second surface, and electrically connected to the circuit board. The conductive connector is arranged at the other side of the circuit board and electrically connected to the circuit board. The lamp shade is assembled with the conductive connector such that the circuit board and the lighting module are arranged between the lamp shade and the conductive connector.

In an embodiment of the present invention, wherein the lighting module further comprises a phosphor layer, the phosphor layer covers the LED dies.

In an embodiment of the present invention, wherein the transmissive substrate is rectangular, and the electrode component is arranged on a widthwise direction of the transmissive substrate.

In an embodiment of the present invention, wherein the LED bulb further comprises a driver placed on the circuit board and electrically connected thereto.

In an embodiment of the present invention, wherein the LED dies are placed on the first surface and the second surface, respectively, the LED dies placed on the first surface and the LED dies placed on the second surface are arranged in the same arrangement.

In an embodiment of the present invention, wherein the LED dies are placed on the first surface and the second surface, respectively, the LED dies placed on the first surface and the LED dies placed in the second surface are arranged in a stagger manner.

In an embodiment of the present invention, wherein the LED bulb further comprises a plurality of lighting modules, the electrode components of the lighting modules are respectively inserted into a plurality of slots formed on the circuit board such that the transmissive substrate of each lighting module stands on the circuit board.

In an embodiment of the present invention, wherein the lighting modules are linearly arranged on the circuit board, and a distance between two adjacent lighting module is a constant.

In an embodiment of the present invention, wherein a transmittance of the transmissive substrate is larger than 50%.

In an embodiment of the present invention, wherein a material of the transmissive substrate is selected from a group including Aluminum oxide, Gallium nitride, glass, Gallium phosphide, Silicon carbide, and chemical vapor deposition diamond.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

A preferred embodiment of the present invention will be described with reference to the drawings.

Figure 1:
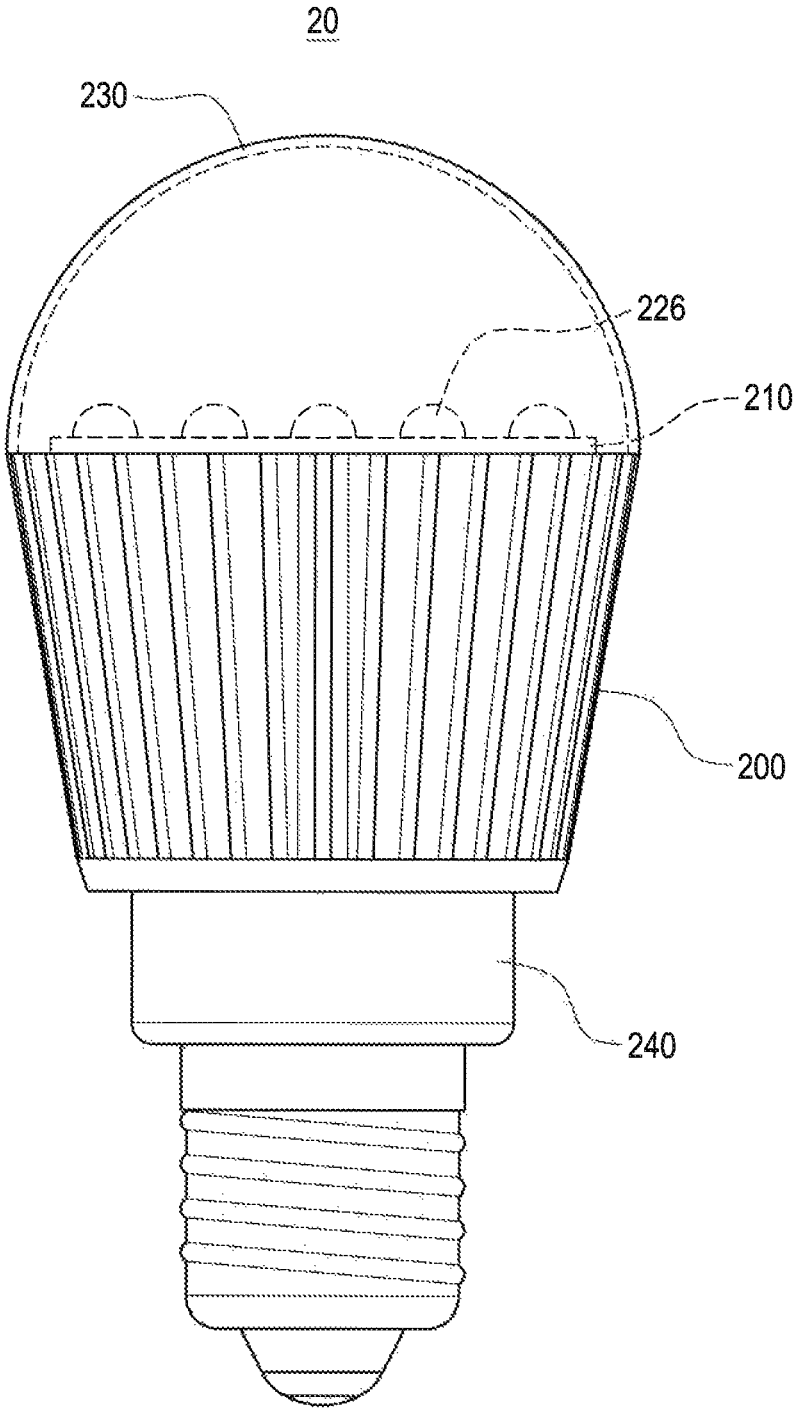
FIG.1 RELATED ART
FIG. 1 is a lateral view of a conventional light emitting diode (LED) bulb.
Figure 2:
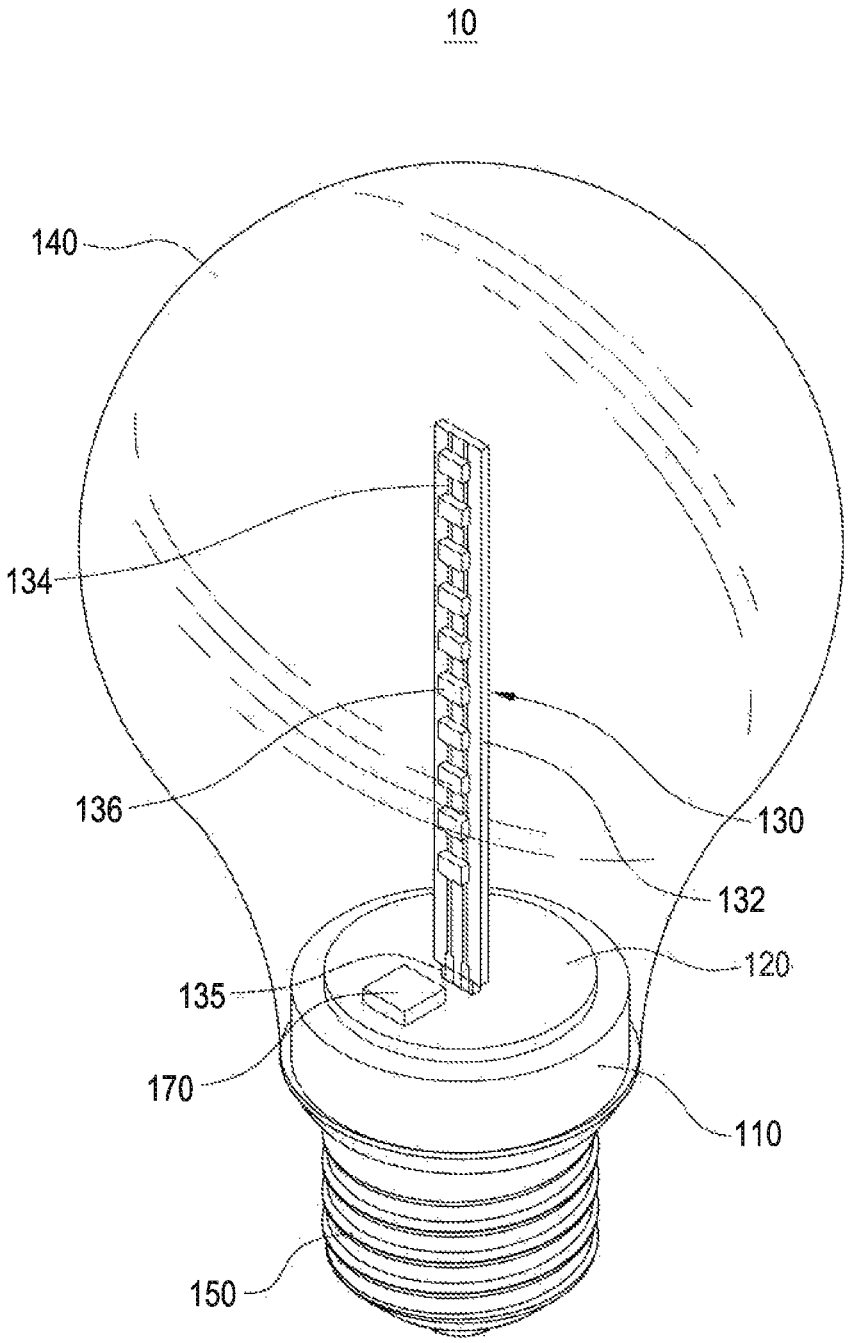
FIG. 2 is a perspective view of an LED bulb according to a first embodiment of the present invention.
Figure 3:
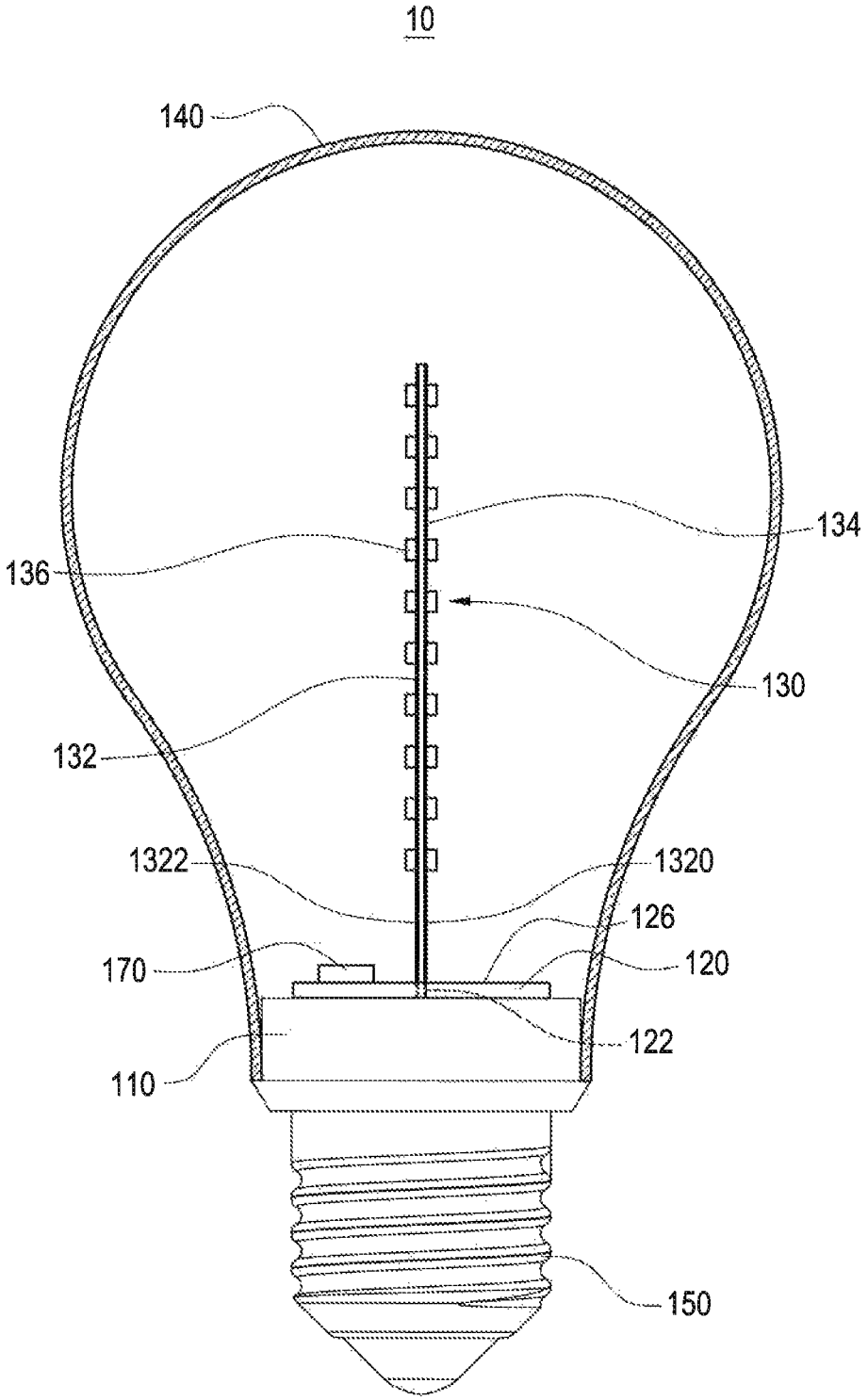
FIG. 3 is a sectional view of the LED bulb according to the first embodiment of the present invention.

Referred is made to FIG. 2 and FIG. 3, which are respectively a perspective view and sectional view of a light emitting diode (LED) bulb according to a first embodiment of the present invention. The LED bulb 10 is used for providing a light source with a particularly illuminate intensity similar to that of incandescent. The LED bulb 10 includes a lamp holder 110, a circuit board 120, at least one lighting module 130, a lamp shade 140, and a conductive connector 150.

The lamp holder 110 is, for example, made of plastic or ceramic. In this embodiment, the lamp holder 110 is of cylinder shape. However, the profile of the lamp holder 110 mentioned above is used for demonstration and is not limitation of the claim scope of the present invention. The lamp holder 110 is used for supporting the circuit board 120 and the lighting module 130.

The circuit board 120 is arranged on one side of the lamp holder 110. In this embodiment, the circuit board 120 is FR-4 glass fiber circuit board with characteristics of high mechanical strength, nonflammable, and moisture-proof. However, in the practical application, the circuit board 120 can be metal core printed circuit board (PCB) or other printed circuit board. Moreover, the circuit board 120 is circular, and a surface area of the circuit board 120 is smaller than a surface area of a surface of the housing 110 contacted with circuit board 120. The circuit board 120 includes at least a slot 122, the slot 122 is a slot structure penetrating through the circuit board 120. A driver 170 for driving the lighting module 130 to emit light is placed on the circuit board 120. The driver 170 is electrically connected to the circuit board 170.

The lighting module 130 includes a transmissive substrate 132, a circuit layer 134, an electrode component 135, and a plurality of LED dies 136. The transmissive substrate 132 is a glass substrate, and a transmittance of the transmissive substrate 132 is larger than 50%. In particularly, the transmittance is a ratio between an illuminant intensity of light passing through the transmissive substrate 132 and an illuminant intensity of light entering the transmissive substrate 132. The material of the transmissive substrate 132 can be selected from a group including Aluminum oxide, Gallium nitride (GaN), glass, Gallium phosphide (GaP), Silicon carbide (SiC), and chemical vapor deposition (CVD) diamond. The transmissive substrate 132 includes a first surface 1320 and a second surface 1322 opposite to the first surface 1320. In this embodiment, the transmissive substrate 132 is rectangular, and the first surface 1320 and the second surface 1322 are two surfaces having larger area. However, in the practical application, the profile of the transmissive substrate 132 can be adjusted to be other shape such as circular or polygon based on the different situations.

The circuit layer 134 is attached to at least one of the first surface 1320 and the second surface 1322 of the transmissive substrate 132. The circuit layer 134 is made of material having characteristic of electrically conductive (such as copper) and used for electric power conductive path. In this embodiment, the circuit layer 134 is simultaneously attached to the first surface 1320 and the second surface 1322 with strip-shape, and a length of the circuit layer 134 attached on the first surface 1320 is the same as a length of the circuit layer 134 attached on the second surface 1322.

The electrode component 135 is arranged on one end of the transmissive substrate 132 and electrically connected to the circuit layer 134. In this embodiment, the electrode component 135 is arranged on a widthwise side of the transmissive substrate 132 and electrically connected to the circuit layer 134. The electrode component 135 is inserted into the slot 122 such that the transmissive substrate 132 stands on the circuit board 120, the first surface 1320 and the second surface 1322 is perpendicular to a plane 126 of the circuit board 120, and the circuit board 120 is electrically connected to the light module 130. In particularly, solder (not shown) can be placed between the electrode component 135 and the slot 122 for fastening the electrode component 135 on the circuit board 120 such that combing strength and electrically conduction between the electrode component 135 and the circuit board 120 can be effectively increased.

The LED dies 136 are placed on at least one of first surface 1320 and the second surface 1322 of the transmissive substrate 132, respectively, and electrically connected to the circuit layer 132. The LED dies 136 can be electrically connected in series, in parallel or in series-parallel connection via the circuit layer 134. In this embodiment, the LED dies 136 are placed on the first surface 1320 and the second surface 1322, respectively. The amount of the LED dies 136 placed on the first surface 1320 is the same as the amount of the LED dies 136 placed on the second surface 1322, and the arrangement of the LED dies 136 placed on the first surface 1320 is the same as the arrangement of the LED dies 136 placed on the second surface 1322, namely the LED dies 136 placed on the first surface 1320 and the LED dies 136 placed on the second surface 1322 are arranged in the same manner. The LED dies 136 are placed on the transmissive substrate 132 by die attachment, and then electrically connected to the circuit layer 134. The LED dies 136 can be flip chip LED dies for directly attaching to the circuit layer 134, however, the LED dies 136 can also be horizontal or vertical structure LED dies for electrically connecting to the circuit layer 134 via at least one metallic wire. In the present invention, light emitted from the LED dies 136 cannot be shielded or absorbed by the transmissive substrate 132 during to the transmittance of the transmissive substrate 132 is larger than 50%, therefore the light-use efficiency of the LED bulb 10 can be effectively enhanced.

The conductive connector 150 is arranged on the other side of the circuit board 120 and assembled with the lamp shade 140 such that the circuit board 120 and the lighting module 130 are respectively arranged between the conductive connector 150 and the lamp shade 140. The lamp shade 140 can be selected to be transparent or semi-transparent to modulate illuminant intensity of light emitting from the lamp shade 140. Moreover, the lamp shade 140 can also modulate lighting characteristic (converge light or diverge light) of light passing therethrough, therefore the optical characteristic of the LED bulb 10 can fit practical demand. The conductive connector 150 is used for connecting to a lamp socket for receiving an electric power to light the LED dies 136. A plurality of power wires (not shown) can be arranged between the conductive connector 150 and the circuit board 120 to electrically connect the conductive connector 150 and the circuit board 120. The power wires penetrate the housing 110. The power wires is used for transmitting the electric power to the circuit board 120, and the electric power transmits to the lighting module 130 via the electrode component 135 to light the LED dies 136.

Figure 4:
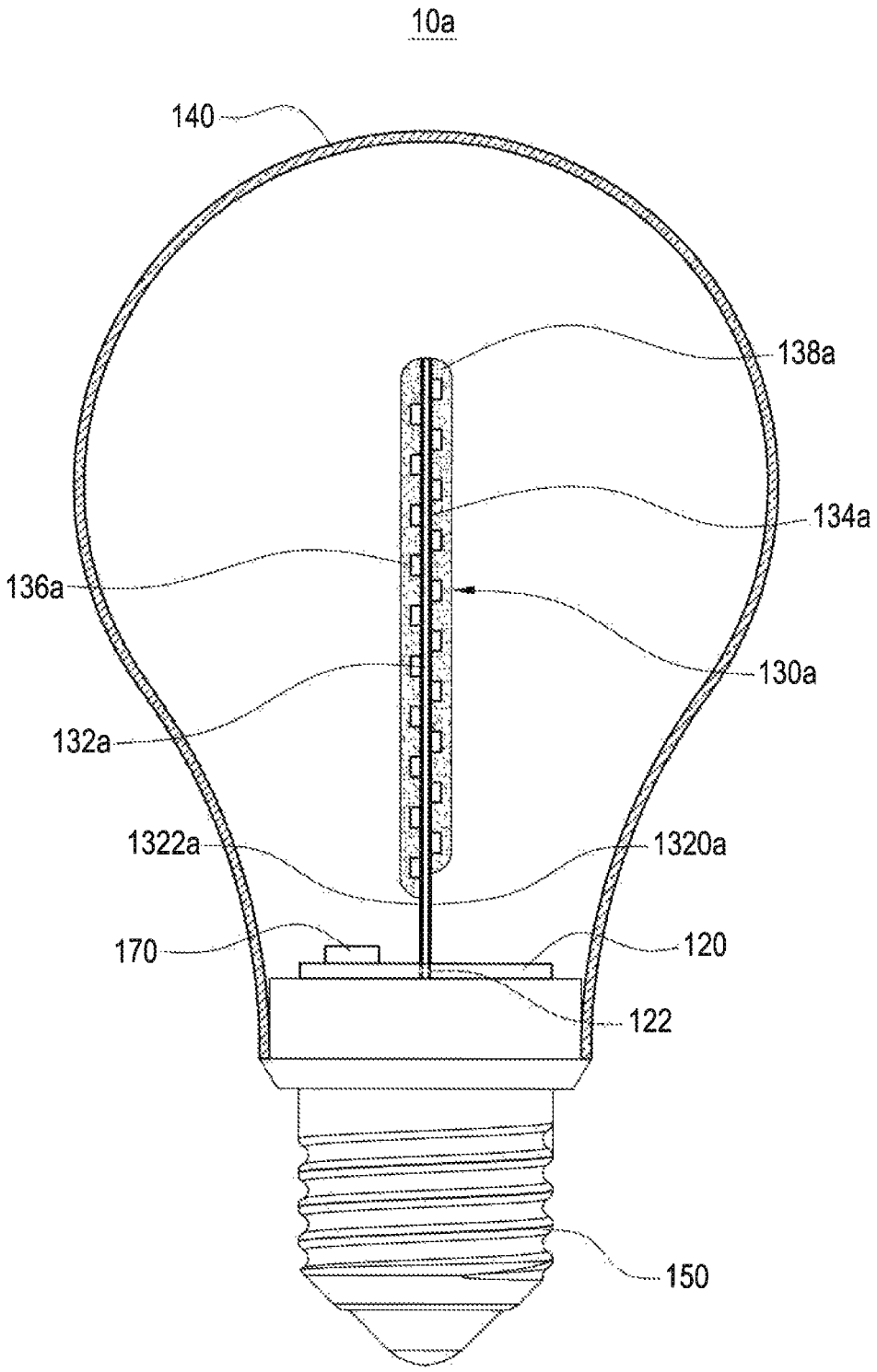
FIG. 4 is a sectional view of an LED bulb according to a second embodiment of the present invention.

Referred is made to FIG. 4, which is a sectional view of a LED bulb according to a second embodiment of the present invention. The LED bulb 10*a* is similar to the LED bulb 10 mentioned in the first embodiment, and the same reference numbers are used in the drawings and the description to refer to the same parts. It should be noted that a lighting module 130*a* shown in the FIG. 4 is different from the lighting module 150 shown in FIG. 3.

The lighting module 130*a* includes a transmissive substrate 132*a*, a circuit layer 134*a*, a plurality of LED dies 136*a*, and a phosphor layer 138*a*. The circuit layer 134*a* is attached to a first surface 1320*a* and a second surface 1322*a* opposite to the first surface 1320*a* of the transmissive substrate 132*a*.

The LED dies 136*a* are placed on the first surface 1320*a* and the second surface 1322*a*, respectively, and electrically connected to the circuit layer 134*a*. The LED dies 136*a* placed on the first surface 1320*a* and the LED dies 136*a* placed on the second surface 1322*a* are arranged in a staggered manner.

The phosphor layer 138*a* including a plurality of phosphors covers the LED dies 136*a*. The phosphor layer 138*a* is excited by partial light emitted from the LED dies 136*a* and then converts the light into a wavelength-converted light, which is to be mixed with the other light emitted from the LED dies 136*a* to generate a light with demand color. In this embodiment, the phosphor layer 138*a* simultaneously covers the LED dies 136*a* placed on the first surface 1320*a* and the second surface 1322*a*, which is convenient to be manufacture. However, the phosphor layer 138*a* can cover at least one of the LED dies 136*a*. The function and relative description of other components of the LED bulb 10*a* are the same as that of first embodiment mentioned above and are not repeated here for brevity, and the LED bulb 10*a* can achieve the functions as the LED bulb 10 does.

Figure 5:
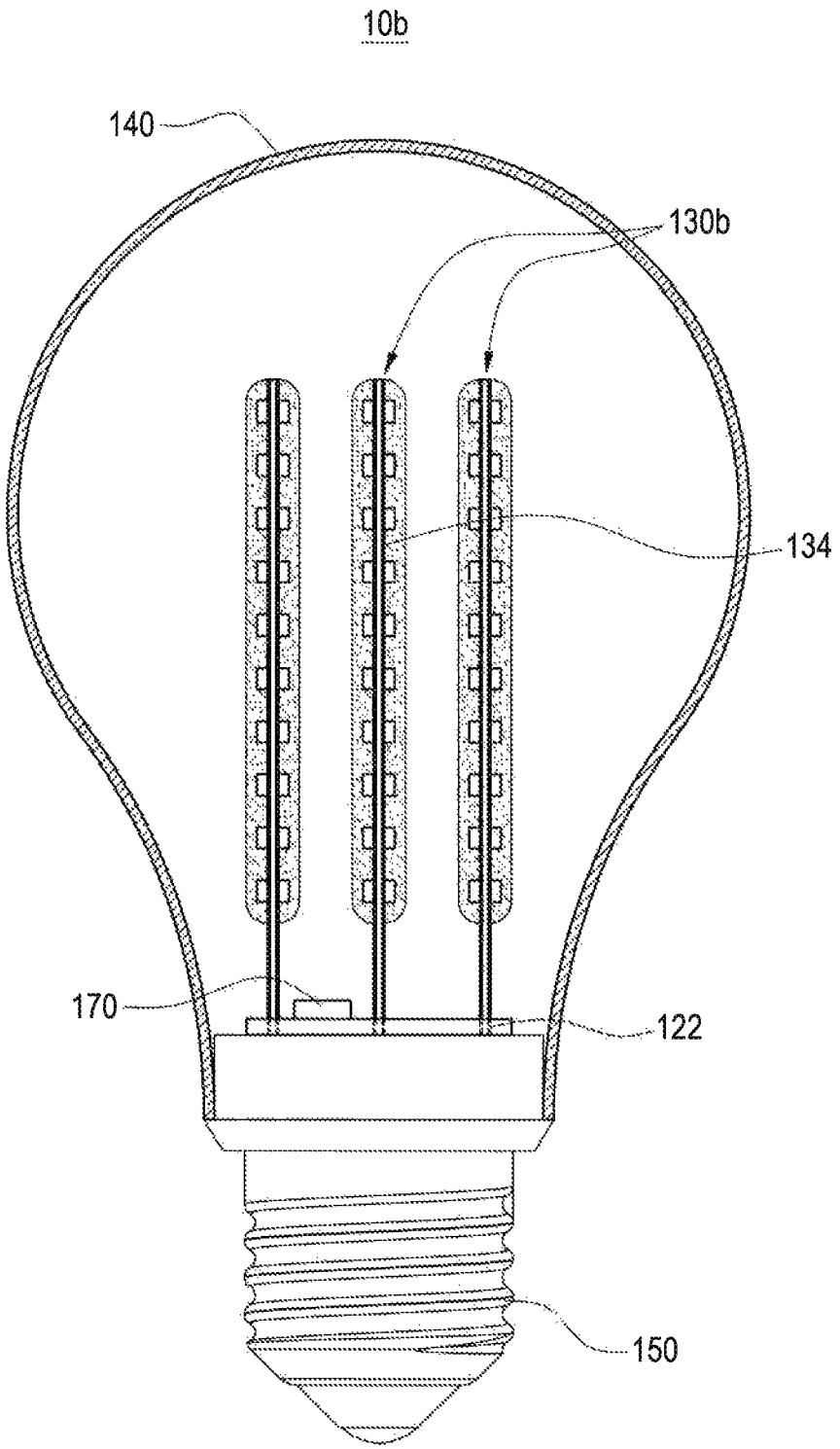
FIG. 5 is a sectional view of an LED bulb according to a third embodiment of the present invention.

Referred is made to FIG. 5, which is a sectional view of a LED bulb according to a third embodiment of the present invention. The LED bulb 10*b* is similar to the LED bulb 10*b* mentioned in the second embodiment, and the same reference numbers are used in the drawings and the description to refer to the same parts. It should be noted that the LED bulb 10*b* includes a plurality of lighting modules 130*b* arranged in linear manner.

The lighting modules 130*b* are respectively inserted into a plurality of slots 122 formed on the circuit board 120 to receiving an electric power for lighting the LED bulb 10*b*. A distance between two adjacent lighting modules 130*b* is a constant, therefore luminance of the LED bulb 10*b* can be effectively enhanced and a light source with uniform illuminant intensity can be provided. However, in the practical application, the arrangement (such as irregular) of the lighting modules 130*b* can be modulated by demand illuminant intensity. The function and relative description of other components of the LED bulb 10*b* are the same as that of first embodiment mentioned above and are not repeated here for brevity, and the LED bulb 10*b* can achieve the functions as the LED bulb 10*a* does.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An LED bulb comprising:

a circuit board comprising at least one slot;

a lighting module comprising:

a light-transmissive substrate comprising a first surface having a first end portion, and a second surface having a second end portion and arranged opposite to the first surface;

a circuit layer attached to the first surface, the second surface, or both;

an electrode component arranged on the first end portion, the second end portion, or both, and electrically connected to the circuit layer, the electrode component capable of being inserted into the slot such that the light-transmissive substrate can stand on the circuit board; and a plurality of LED dies placed on the first surface, the second surface, or both;

an electrical connector electrically connected to the circuit board; and a lamp shade assembled with the electrical connector, wherein the first end portion or the second end portion passes through the slot.

2. The LED bulb in claim 1, wherein the lighting module further comprises a phosphor layer covering the plurality of LED dies.

3. The LED bulb in claim 1, wherein the light-transmissive substrate is formed in a rectangular shape, the electrode component is disposed on a widthwise direction of the light-transmissive substrate.

4. The LED bulb in claim 1, further comprising a driver placed on the circuit board and electrically connected thereto.

5. The LED bulb in claim 1, wherein the LED dies comprise a first group placed on the first surface and a second group placed on the second surface, the first group and the second group have the same arrangement.

6. The LED bulb in claim 1, wherein the LED dies are placed on the first surface and the second surface in a staggered configuration.

7. The LED bulb in claim 1, wherein the light-transmissive substrate has a transmittance of larger than 50%.

8. The LED bulb in claim 1, wherein the light-transmissive substrate comprises a material selected from a group including Aluminum oxide, Gallium nitride, glass, Gallium phosphide, Silicon carbide, and chemical vapor deposition diamond.

9. The LED bulb in claim 1, wherein the circuit layer and the electrode component are substantially coplanar or physically connected to each other.

10. The LED bulb in claim 1, wherein the electrode component has a width greater than that of the circuit layer.

* * * * *